US008307890B2

(12) United States Patent
McGarian

(10) Patent No.: US 8,307,890 B2
(45) Date of Patent: Nov. 13, 2012

(54) WHIPSTOCK ASSEMBLY

(75) Inventor: Bruce McGarian, Aberdeenshire (GB)

(73) Assignee: ITS Tubular Services (Holdings) Limited, Aberdeen (GB)

( * ) Notice: Subject to any disclaimer, the term of this patent is extended or adjusted under 35 U.S.C. 154(b) by 256 days.

(21) Appl. No.: 12/673,002

(22) PCT Filed: Aug. 21, 2008

(86) PCT No.: PCT/GB2008/050729

§ 371 (c)(1),
(2), (4) Date: May 24, 2010

(87) PCT Pub. No.: WO2009/027728

PCT Pub. Date: Mar. 5, 2009

(65) Prior Publication Data

US 2011/0308785 A1 Dec. 22, 2011

(30) Foreign Application Priority Data

Aug. 24, 2007 (GB) ..... 0716554.1

(51) Int. Cl.
*E21B 23/03* (2006.01)

(52) U.S. Cl. ..... 166/117.5; 175/80

(58) Field of Classification Search ..... 166/117.5, 166/117.6; 175/80, 81

See application file for complete search history.

(56) References Cited

U.S. PATENT DOCUMENTS 2,105,722 A * 1/1938 Barrett et al. ..... 175/81
2,882,015 A * 4/1959 Beck ..... 166/55.3

FOREIGN PATENT DOCUMENTS

GB 2420359 A 5/2006

OTHER PUBLICATIONS

International Search Report for International Application No. PCT/GB2008/050729 (Jul. 7, 2009).
Communication pursuant to Rules 161(1) and 162 EPC for European Patent No. 2179122 (Apr. 14, 2010).
International Preliminary Report on Patentability and Written Opinion of the International Searching Authority for International Application No. PCT/GB2008/050729 (Feb. 24, 2010).

* cited by examiner

*Primary Examiner* — William P Neuder
(74) *Attorney, Agent, or Firm* — Jenkins, Wilson, Taylor & Hunt, P.A.

(57) ABSTRACT

A whipstock assembly for milling an aperture in a casing of an oil, gas or water well, the whipstock assembly having a whipstock with a deflection face (6) for deflecting a milling head of a milling device to cut through the casing. The whipstock has a plateau portion (7) raised above the plane of the deflection face to support the milling head as it engages the casing. The plateau can induce the milling device to pivot around one of the milling heads during some of the milling operations, which optimizes the stress applied to the heads of the milling device.

20 Claims, 6 Drawing Sheets

WHIPSTOCK ASSEMBLY

The present invention relates to a whipstock assembly.

Whipstocks are well known in the oil and gas industry, for deviating a mill from the normal path taken by a wellbore of an oil or gas well (or a water well) through the side of the wellbore, typically in order to cut through the metal casing lining the wellbore, and drill a deviated (or lateral) wellbore. The reasons for drilling lateral wellbores are varied, but typically the direction of the wellbore is changed during drilling because of some unforeseen event or complication with the original direction of the main wellbore, although in some circumstances laterals can be drilled from a main wellbore as a matter of choice, in order to access another part of the reservoir.

Typically a whipstock assembly comprises a milling device for cutting the lateral borehole, a deflection device for deflecting the milling device towards the new path of the lateral borehole, and usually an anchor in order to restrain the deflection device within the borehole at a predetermined position.

Typically the anchor device comprises a packer, the deflection device comprises a whipstock and the milling device comprises a mill or drill bit, usually having more than one head adapted for cutting through the casing of the main wellbore.

According to the present invention there is provided a whipstock assembly for milling an aperture in a casing, the whipstock assembly having:

- a whipstock having a longitudinal axis, and a deflection face which is angled with respect to the longitudinal axis to guide the mill through the casing; and
- a milling device, connectable to the whipstock, the milling device having upper and lower milling heads arranged sequentially on the milling device;
- wherein the whipstock has a plateau portion raised above the plane of the deflection face to support the lower milling head as it engages the casing.

Optionally the mill can have upper, lower and middle milling heads.

Typically the plateau portion supports the lower milling head as it cuts through the casing. The plateau portion typically has an angled guide face to guide the path of the lower milling head through the casing. Typically the angled guide face of the plateau portion is arranged at the same angle as the angled face of the deflection surface, so that the two faces are parallel to one another.

Typically the milling device can be adapted to pivot around the middle milling head. The upper and middle milling heads are typically simultaneously deflected through the casing.

The deflection face can typically extend at an oblique angle with respect to the axis, typically 2-5°, for example 3°, with respect to the longitudinal axis. The deflection face is typically angled towards the intended position of the aperture in the casing. For example, at its upper end the whipstock is typically thin and the radial dimensions of the deflection face typically increase with depth and proximity to the intended position of the aperture, so that the deflection face extends at an angle from the thin upper end to the thick lower end, across the longitudinal axis of the casing. Thus, the lower end of the milling assembly can slide over the thin upper end of the whipstock located at one side of the casing, and is guided by the angled deflection face towards the intended position on the other side of the casing where the aperture is to be formed.

The deflection face and the plateau portion can be formed from or faced with hard material adapted to withstand milling to a greater extent than the casing. In some embodiments, the plateau portion can be adapted to be milled by parts of the milling device and can function as a temporary supporting structure for the lower head. In some embodiments the whole of the whipstock is typically made from material that is hardened, either before or after forming the deflection face and the plateau portion.

The interaction between the lower milling head and the whipstock typically lifts the middle or subsequent milling head onto the deflection surface. The interaction between the middle or subsequent milling head and the whipstock typically lifts the lower milling head onto the plateau portion.

The axial length of the plateau portion can be selected in accordance with the dimensions of the casing, mill and the whipstock in order to provide the supporting effect on the lower milling head during its cutting operation. Typically the plateau portion extends axially only so far as is necessary to support the lower milling head during its radial cutting operation, and after the lower milling head has cut radially through the outer skin of the casing, the plateau portion is no longer needed. Thus it will be appreciated that the axial length of the plateau portion can be varied in accordance with the angle of the deflection face. In particular, if the angle of the deflection face is shallow, e.g. 1-2° then the lower milling head will be deflected at a correspondingly shallow angle and will have a relatively long dwell time and correspondingly long axial track when cutting through the casing wall. Accordingly, the plateau portion in such embodiments will typically be relatively long in the axial direction, so that it supports the lower milling head from the axial position at which it first engages the inner face of the casing, to the axial position lower down the whipstock at which it breaks through the outer face of the casing. In contrast, if the angle of the deflection face is steeper, e.g., 4-5° then the axial track length for the lower milling head while cutting through the casing will be shorter in the axial direction.

Typically the plateau portion is consumed by the middle mill.

The radial dimension of the plateau portion can be varied. The radial dimension is typically sufficient to divert the lower milling head towards the inner surface of the casing, so that the plateau portion supports the lower milling head closer to the inner surface of the casing than the deflection face. Typically the plateau portion causes the milling device to pivot around one of the milling heads, usually the middle milling head, so that the angle of incidence of the milling device with respect to the casing is altered by the interaction between the lower milling head and the plateau portion. In certain embodiments, the height of the plateau portion can be selected to be approximately the same as the radial difference in height between the lower and middle milling heads, or between the lower and the upper milling heads. The radius of the face of the plateau portion can be matched to the radius of the lower milling head, in order to reduce the tendency of the lower milling head to deviate from the plateau portion during cutting operations of the lower milling head through the casing. In certain embodiments the radius of the face of the plateau portion can be very slightly larger than the radius of the lower milling head.

Typically the lower milling head has a different radial dimension to the upper (and optionally middle) milling head. The lower milling head typically has a narrower diameter than the upper milling head. In embodiments having three milling heads, the upper and middle milling heads typically have a similar apical diameter, which is larger than the apical diameter of the lower milling head. The plateau portion typically extends radially to an extent that in use pivots the milling device around the middle milling head, and pushes the apex of the lower milling head radially outwards to engage the inner surface of the casing at substantially the same time as the middle milling head. The plateau portion typically extends circumferentially to the edge of the whipstock.

The milling heads can have blades to cut through the casing, and the blades can optionally be helically offset in relation to one another. In some embodiments of the invention, the trailing end of one blade on a milling head can optionally be circumferentially aligned with the leading end of an adjacent head. The blades can have cutting faces provided with various appropriate materials, from a crushed carbide composite rod, tungsten carbide inserts, buttons or cylindrical cutters, or similar.

In a first phase of the cutting operation, the interaction between the whipstock and the lower milling head typically moves the middle and upper milling heads out of alignment with the axis of the casing, and forces the middle and upper milling heads into engagement with the casing wall. The milling device can be adapted to pivot around the middle milling head, so as to reduce contact between the lower milling head and the whipstock, thereby reducing damage to the whipstock during the casing cutting process.

Optionally the whipstock can have second or further plateau portions, which can be useful in supporting the lower milling head during cutting through subsequent layers of casing disposed in concentric arrays around the outside of the abovementioned casing.

The anchor can be a mechanical anchor. In some circumstances the anchor can be hydraulically set, and can typically comprise a packer, for example an inflatable packer. The anchor could be mechanically set.

An embodiment of the invention will now be described by way of example, with reference to the accompanying drawings, in which.

Figure 1:
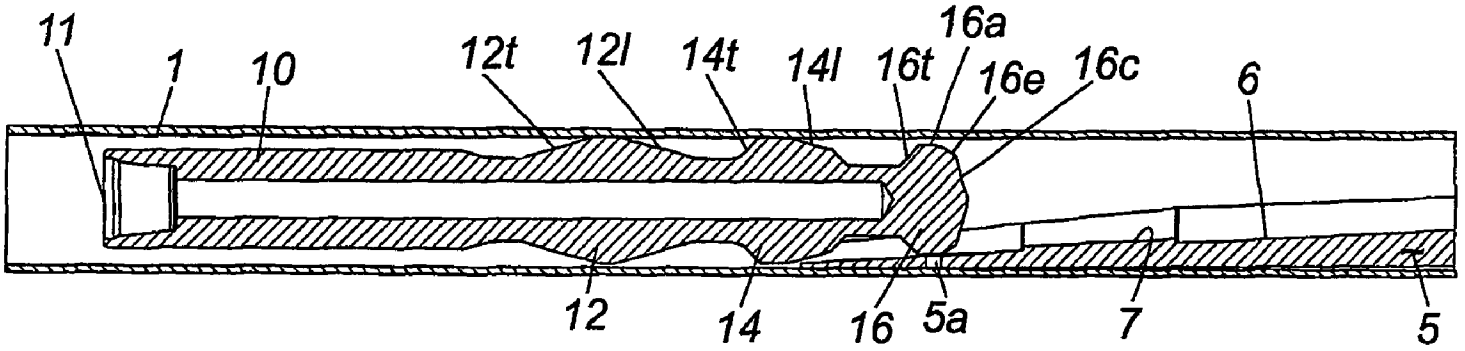
FIGS. 1-7 show sequential side sectional views of a first embodiment of a whipstock assembly in which the milling device is being deflected through casing.

Referring now to the drawings, a whipstock assembly is anchored in the bore of casing 1, and typically comprises a whipstock 5, an anchor (not shown) anchoring the whipstock 5 within the bore of the casing 1, and a milling device 10. The milling device 10 is typically adapted to be attached to the lower end of a drill string (not shown) and can have a box or pin connector at its upper end 11 for this purpose. The milling device 10 has an upper milling head 12, a middle milling head 14, and a lower milling head 16, extending radially outwards in a radially symmetrical arrangement from a central shaft, and wherein the heads 12, 14, 16 are spaced axially apart from one another along the shaft. The upper milling head 12 has a generally symmetrical side profile as shown in FIGS. 1-6 with a leading face 121 and a trailing face **12*t* that are substantially identical to one another. The leading face is arranged below the trailing face (to the right of the trailing face in the drawings). The apex between the leading and trailing faces of the upper mill 12 is generally flat and parallel to the axis of the milling device 10, and is spaced radially outwards from the nominal surface of the shaft of the milling device 10**.

The middle milling head 14 is generally asymmetrical in its side profile, and has a leading face 141 that is arranged at a shallower angle than its trailing face **14*t*. The apex between the leading and trailing faces of the middle mill 14 is also radially spaced from the nominal diameter of the shaft of the milling device 10, typically by the same distance as the apex of the upper milling head 12, and can also be generally flat, and typically parallel to the axis of the milling device 10**.

The lower milling head 16 at the lowermost end of the milling device 10 is generally asymmetrical, with conical leading face **16*c*, an elliptical intermediate face 16*e*, an apex 16*a* which is typically flat and parallel to the axis of the milling device, and a trailing face 16*t* with a generally steep angle. The lower milling head 16 has a narrower diameter at its apex 16*a* than the upper and middle milling heads 12, 14**, which typically have substantially the same apical diameter.

The whipstock 5 has a generally convex outer surface 50, and a generally concave inner surface **5*i*, and is adapted to be pivotally attached to a suitable anchoring device such as a packer (not shown) by means of a pivot joint at its lower end 5*l*. The concave outer surface 50 optionally has substantially the same radius of curvature as the inner surface of the casing 1 in which it is to be deployed. The whipstock 5 has a deflection face 6 on its inner surface 5*i* that is adapted to deflect a drill bit away from the central longitudinal axis of the casing 1, so as to drill the lateral bore hole through an aperture or window in the casing once the whipstock is anchored in place in the casing 1**.

The deflection face 6 is arranged at an angle with respect to the longitudinal axis of the casing 1. The angle of the deflection face 6 can be varied in accordance with the requirements of the lateral bore hole to be drilled, but is typically in the region of 2-5° e.g. 3°. The embodiments in the figures show that the deflection face 6 has an angle of 3°, and the deflection face 6 is angled from bottom left to top right as shown in the drawings.

A generally quadrilateral concave plateau portion 7 extends radially from the inner concave deflection face 6, and extends circumferentially across the whole of the inner **5*i* face of the whipstock. The plateau portion 7 is spaced from the upper end of the whipstock, so that above and below the plateau portion 7 there is a respective upper 6*u* and lower 6*l* portion of plain angled deflection face 6 set at a typical angle of around 3° with respect to the axis of the whipstock 5. The plateau portion 7 in this embodiment rises above the deflection face 6** by approximately 5-10 mm.

Figures 8, 9, 10, 11, 12, 13, 14, 15:
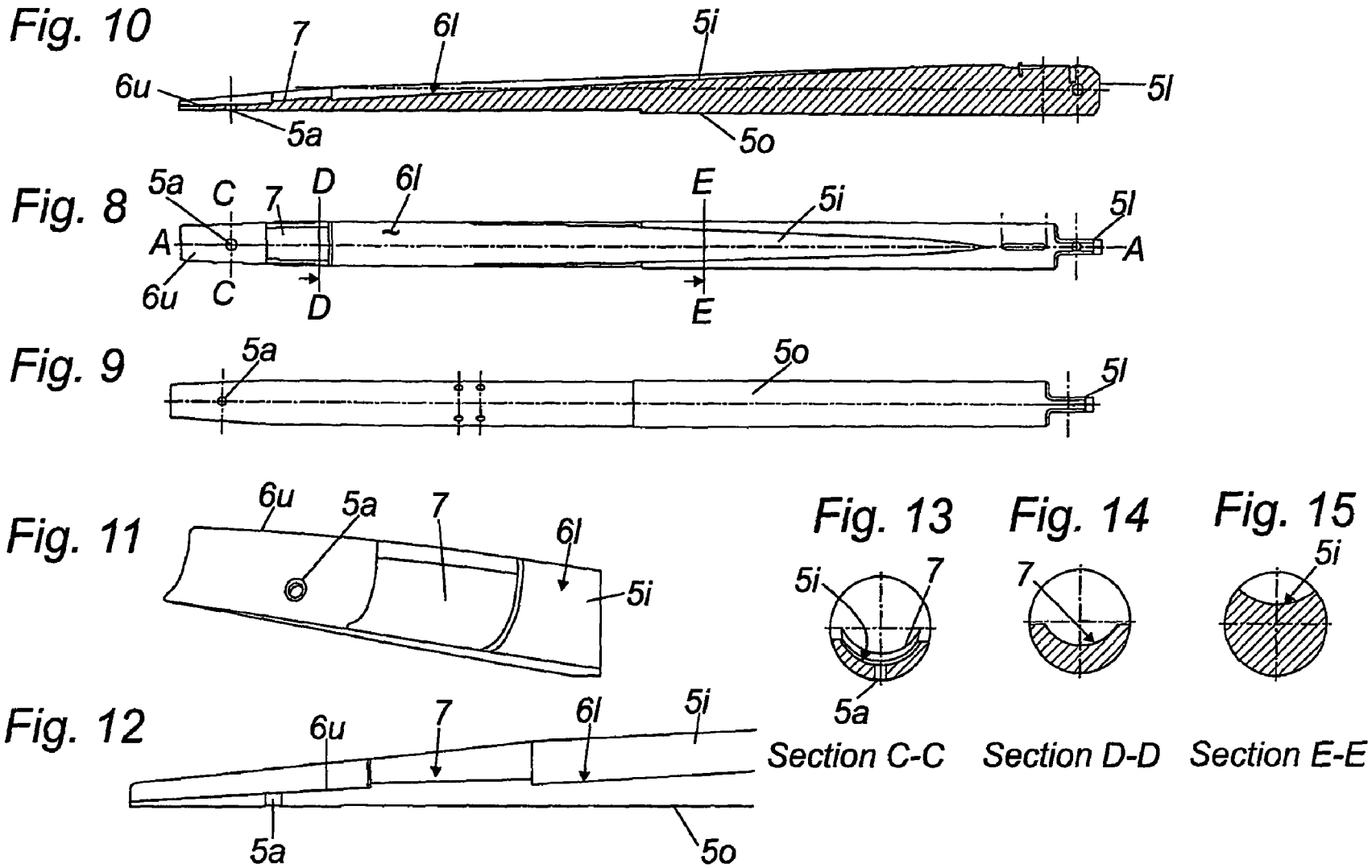
FIG. 8 is a plan view of the whipstock shown in the assembly of FIGS. 1-7.
FIG. 9 is a view from beneath the FIG. 8 whipstock.
FIG. 10 is a side sectional view through the line A-A of FIG. 8.
FIG. 11 is a perspective view of the tip of the FIG. 8 whipstock.
FIG. 12 is an enlarged side view of the tip of the FIG. 8 whipstock.
FIGS. 13, 14 and 15 are respective sectional views through lines C-C, D-D and E-E in FIG. 9.

As shown in FIG. 8, the sides of the whipstock 5 can be tapered gently.

In operation, the whipstock assembly is run into the hole with the anchor unset, and with the lower end of the milling device 10 connected to the upper end of the whipstock 5 by means of a shear pin extending through an aperture **5*a* in the upper portion 6*u* of the deflection face of the whipstock 5. The connection between the whipstock and the milling device typically allows pivotal movement of the two relative to one another, so that the assembly can be run in along arcuate lengths of casing or pipe. After the whipstock is located at the desired depth and rotational position for optimum placement of the lateral bore hole, the anchor is set and the milling device 10 is disconnected from the whipstock 5, typically by picking up weight, or setting it down, in order to shear the shear pin between the milling device 10 and the whipstock 5. While the milling device 10 is being rotated by the drill string relative to the stationary anchored whipstock 5 and the casing 1, the drill string is axially advanced through the bore of the casing 1, so that the rotating milling device 10 travels from its initial running in position shown in FIG. 1 to the position shown in FIG. 2 where the lower milling head 16 has begun to travel down the upper portion 6***u* of the deflection face above the plateau portion 7, and is supported by the angled deflection face 6. This radial support of the lower milling head 16 begins to push the milling device 10 off the main axis of the casing 1, so that the lower and middle milling heads 12, 14 are pushed laterally and eccentrically off the axis of the casing 1, towards the inner surface of the casing 1. In the embodiment shown, when the milling device moves off axis by the deflection of the lower milling head by the upper portion of the deflection face 6*u*, the middle milling head 14 is the first to engage the inner surface on the casing 1, thereby initiating the cutting action by the middle milling head 14 just as the middle milling head 14 engages the deflection face 6 of the whipstock 5.

Figure 2:
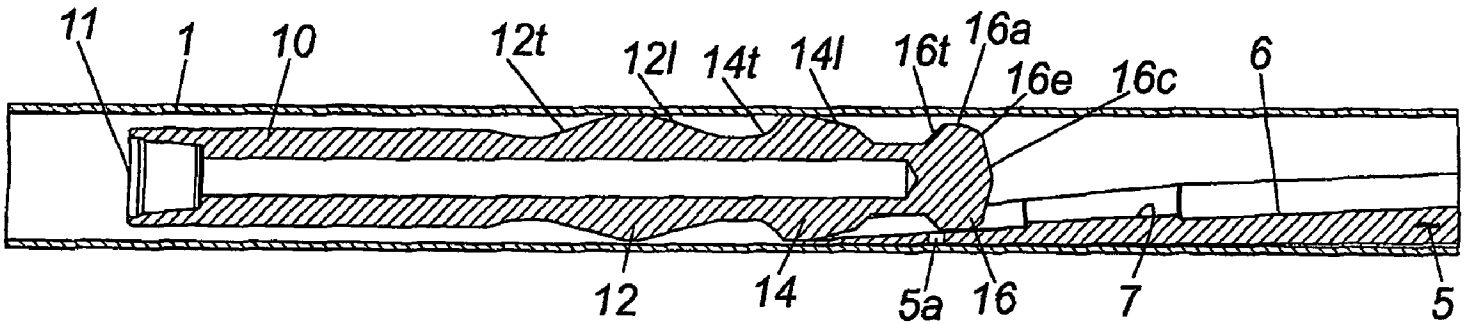
Figure 3:
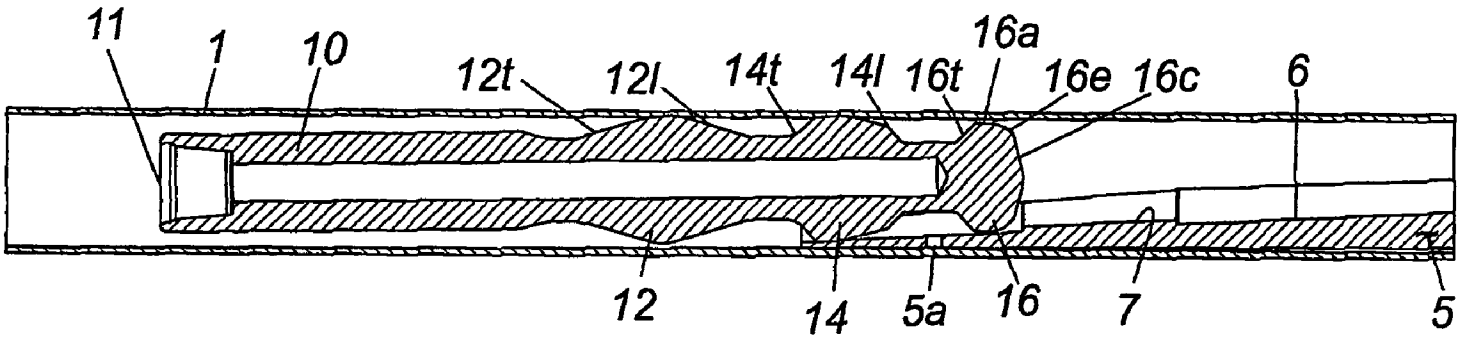

As the downward axial movement of the rotating milling device 10 proceeds along the upper portion 6*u*, the middle milling head 14 is driven up the upper edge of the whipstock 5, so that the milling device 10 engages the whipstock by the lower and the middle milling heads 14 and 16. As the nose of the milling device 10 moves down the upper portion 6*u* of the deflection face above the plateau portion 7, the outer face of the middle milling head 14 is deflected radially into the inner surface of the casing 1 as shown in FIGS. 2 and 3. At about the same time, the upper milling head 12 is deflected into the casing 1. As the milling device is pushed down the bore of the casing 1, the resistance applied by the casing 1 to the middle milling heads cutting into the inner surface of the casing 1, causes the milling device 10 to pivot around the middle milling head 14, thereby keeping the upper milling head 12 engaged with the inner surface of the casing 1, and lifting the lower milling head 16 off the upper portion of the deflection face 6*u* ready to run onto the plateau portion 7 as shown in FIG. 3.

Figures 4, 5, 6, 7:
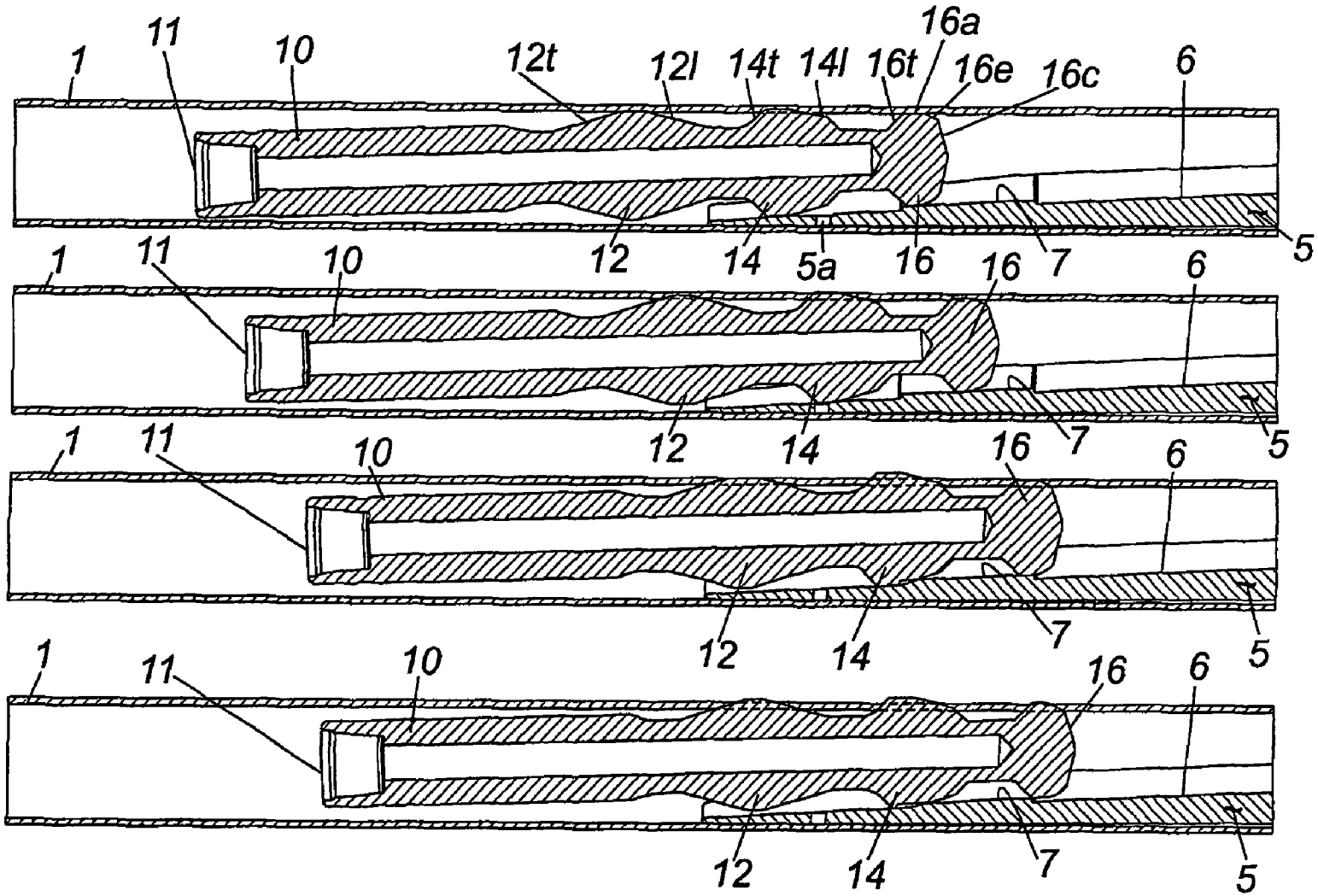

Continued downward movement of the milling device 10 relative to the anchored whipstock 5 moves the middle milling head 14 radially further into the casing wall, and moves the raised lower milling head 16 onto the start of the radially inner face of the plateau portion 7 as shown in FIG. 4. The deflection angle of the radially inner face of the plateau portion is the same as the deflection face, i.e. 3°, so the lower milling head 16 is being deflected radially into the casing in the same way and to the same extent as the middle and upper milling heads 14, 12. At this point the lower and upper milling heads 16, 12 are each engaged with the inner surface of the casing 1, without substantially cutting into it, and the middle milling head is almost fully through the radial wall of the casing. Once the lower milling head 16 is on the plateau portion 7, it is supported in its cutting track by the plateau portion 7, and the lower and upper heads 16, 12 then begin to cut into the inner surface of the casing 1 as shown in the transition from FIG. 4 to FIG. 5. The lower head 16 is supported by the plateau portion 7, and this stabilises both the lower and the upper milling heads 16, 12 during their cutting phases.

The milling process continues in this way with the lower milling head 16 being supported by the whipstock plateau portion 7 throughout its radial movement through the casing wall. Referring now to FIG. 5, at this stage of milling the lower milling head is approximately half way along the axial length of the plateau portion 7, and is slightly more than half way through the radial width of the casing wall 1. The middle milling head 14 has cut through the casing completely at this stage, and the upper milling head 12 is reaching the axial beginning of the window cut by the middle milling head 14. Thus resistance is reducing from the interaction between the mill 10 and the whipstock 5.

The lower milling head 16 breaks through the outer surface of the casing 1 just before it reaches the end of the plateau portion 7, as shown in FIG. 6, so that it is supported by the plateau portion 7 during its radial cutting procedure. As the lower milling head 16 moves off the lower end of the plateau portion 7, the middle milling head 14 is moving onto the plateau portion, which is optionally being consumed at its upper end by the middle milling portion 14.

Once the lower milling head 16 has cut radially through the casing, there is less resistance applied to it by the relatively softer formation, and it does not need to be supported by the whipstock to the same extent as when cutting through casing 1. Thus, after the lower milling head 16 moves off the lower end of the plateau portion, it is held clear of the deflection face 6 while it is cutting, which reduces the extent to which the deflection face is consumed by the milling process at that point. Also, the milling device 10 can be supported by the upper and middle milling heads 12, 14 both of which can bear on the whipstock and support the lower milling head clear of the deflection face 6. At this point, the window is being lengthened primarily by the axial cutting action of the forward facing blades on the conical leading face 16*c* of the lower milling head 16, while it is being widened circumferentially by the action of the middle and lower milling heads 14, 12, and the radial forces acting on the lower milling head are not as great as when it is cutting through the casing 1. Milling continues with the mill 10 proceeding along the track guided by the whipstock until the window is complete and the milling device 10 is fully in the lateral bore newly drilled in the formation.

Figure 16:
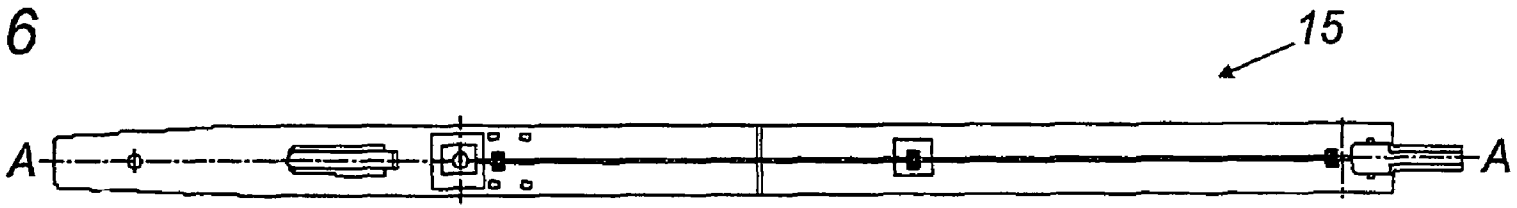
FIG. 16 is a view from beneath a modified embodiment of a whipstock.
Figure 17:
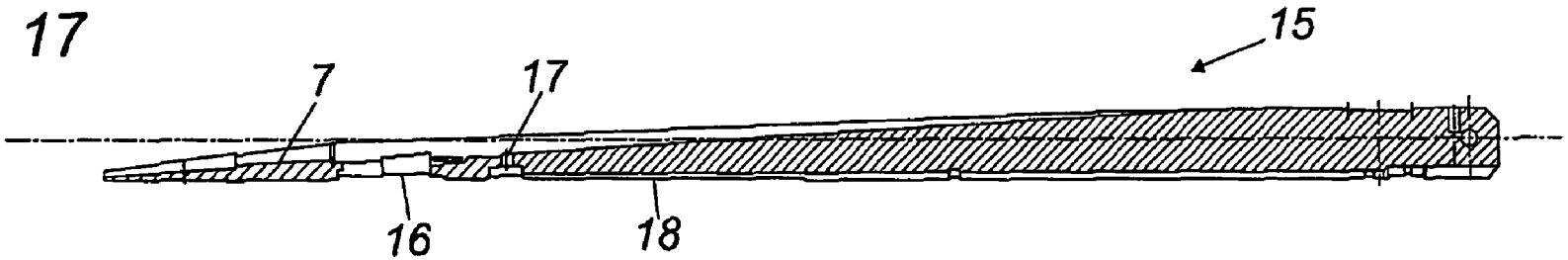
FIG. 17 is a sectional view through the line A-A of FIG. 16.

FIGS. 15 and 16 shown an alternative embodiment of a whipstock 15, which is substantially identical in structure to the whipstock 5, but which has a socket 16 for a retrieval hook used for recovery of the whipstock after the aperture has been drilled and the anchor released. The whipstock 15 also has a hydraulic connector 17 and a hydraulic hose 18 to connect a hydraulic control conduit on the mill to a packer below the whipstock.

According to one modified embodiment shown in FIGS. 18-22, a whipstock can have more than one plateau portion, in order to support the lower milling head during cutting operations through concentric layers of casing or pipe comprising an inner string and an outer string. The considerations concerning location and dimensions of such subsequent plateau portions are similar to those for the plateau portion 7 described above, and typically, the second or subsequent plateau portion can be axially and radially spaced along the deflection face from the above-described plateau portion 7, so as to support the inner surface of the lower milling head 16 at a location that is radially spaced from the inner string of casing, and which coincides with the radial location of the outer string of casing arranged concentrically around the inner string.

FIGS. 18-22 show such an assembly, having the same milling device 10 as previously described, and a modified whipstock 25. The modified whipstock 25 has certain features in common with the whipstocks 5 and 15, and similar features are designated with the same reference number, prefaced by "2". Thus the whipstock 25 has a deflection face 26 on its inner surface that is adapted to deflect a drill bit away from the central longitudinal axis of the casing 1, and which is arranged at an angle. The whipstock 25 has a first plateau portion 27 extending radially from the deflection face 26 below its upper portion 26*u*, which performs as described in relation to the plateau portion 7 above. Below the first plateau portion 27, there is a second plateau portion 28, located between a middle portion of the deflection face 26*m* and a lower portion 26*l*.

The whipstock 25 is set in casing 1, which is concentrically located within an outer string of casing 2 with a larger diameter. The first plateau portion 27 supports the lower milling head 16 during the cut out of the inner string of casing 1, as described above.

Figure 18:
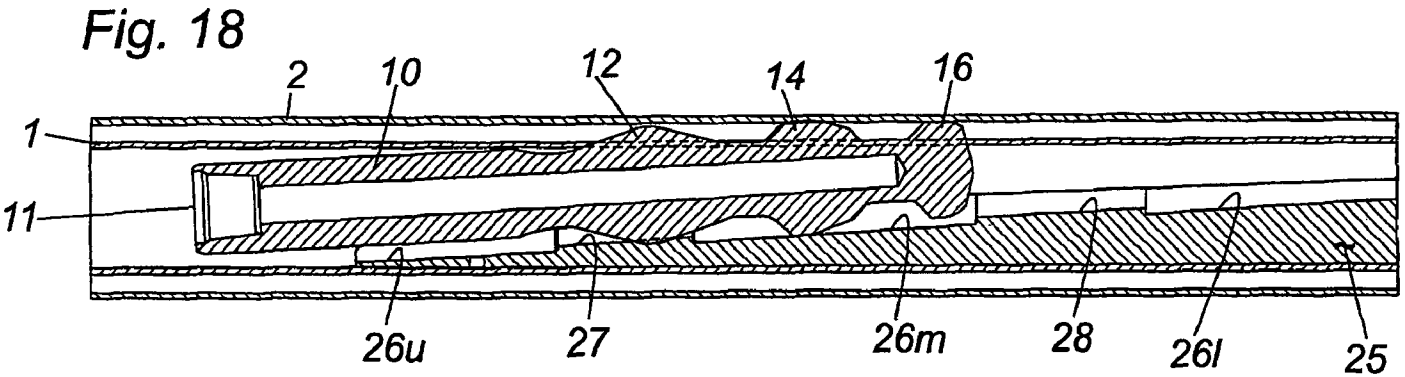
FIGS. 18-22 show sequential side sectional views of a third embodiment of a whipstock assembly in which the mill is being deflected through two concentric strings of casing.
Figure 19:
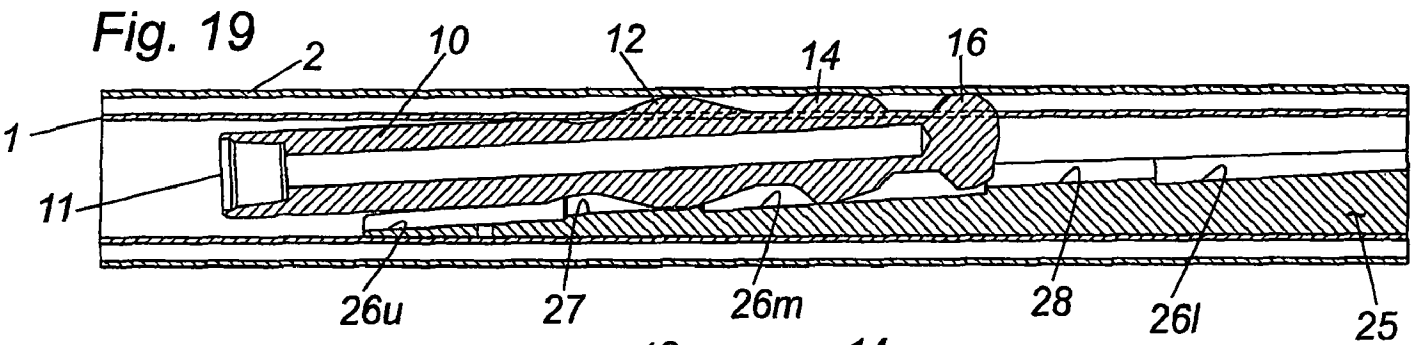
Figure 20:
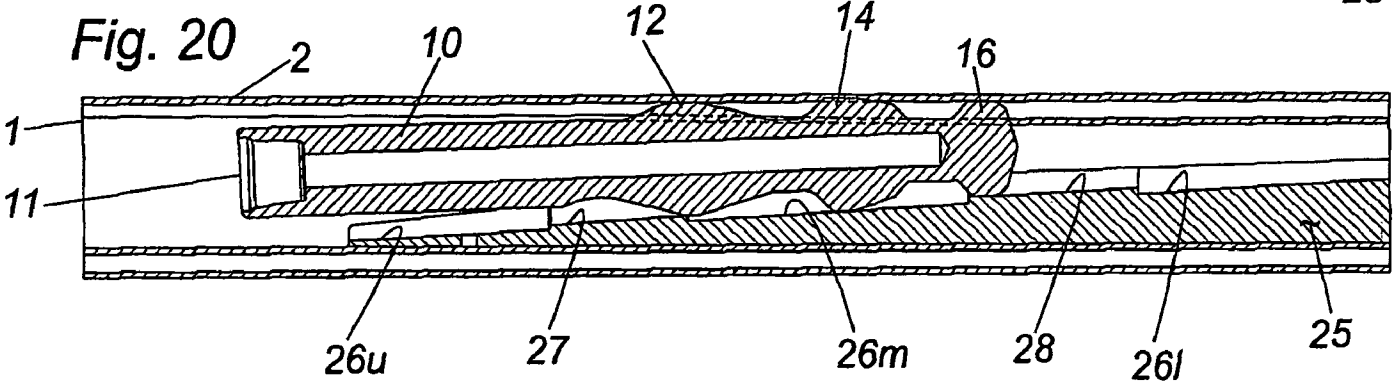

Once a window has been cut through the first casing 1 as described above, the milling device 10 continues axially downs through the bore, and continues to be pushed eccentrically by the whipstock, through the inner surface of the casing strings 1, 2. The lower milling head 16 is kept away from the surface of the whipstock as shown in FIG. 18. When the lower milling head 16 engages the inner surface of the outer string 2, the lower milling head 16 has reached the start of the radially inner face of the second plateau portion 28 as shown in FIG. 20. The deflection angle of the radially inner face of the second plateau portion 28 is the same as the deflection face, i.e. 3°, so the lower milling head 16 is being deflected radially into the casing 2 in the same way and to the same extent as the middle and upper milling heads 14, 12. Once the lower milling head 16 is on the second plateau portion 27, it is supported in its cutting track by the plateau portion 27.

Figure 21:
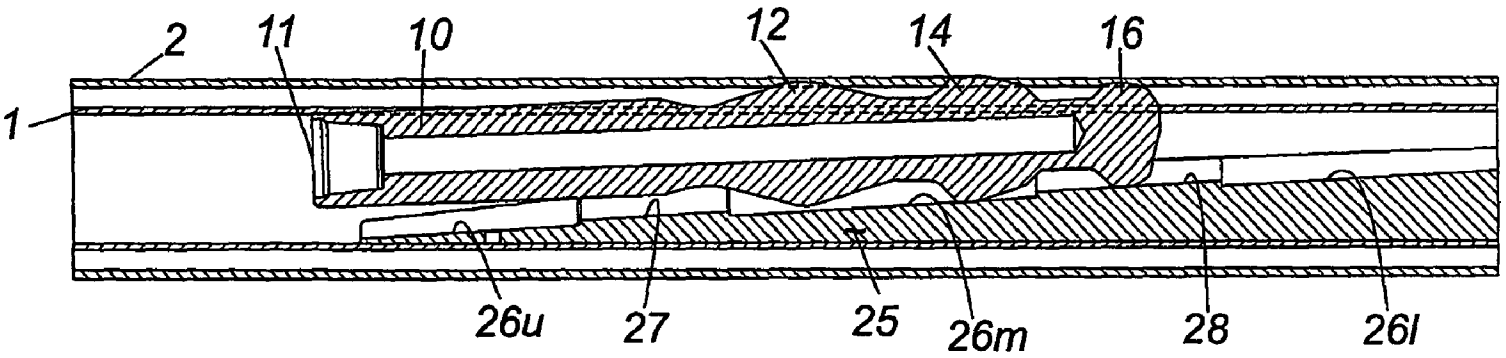

The milling process continues in this way with the lower milling head 16 being supported by the second plateau portion 28 throughout its radial movement through the outer string 2 of the casing wall. Referring now to FIG. 21, at this stage of milling the lower milling head 16 is approximately half way along the axial length of the second plateau portion 28, and is slightly more than half way through the radial width of the casing wall 2. The middle milling head 14 has just cut through the casing completely, and the upper milling head 12 is reaching the axial beginning of the window cut by the middle milling head 14 through the outer string 2. Thus resistance is again reducing from the interaction between the mill 10 and the whipstock 5.

Figure 22:
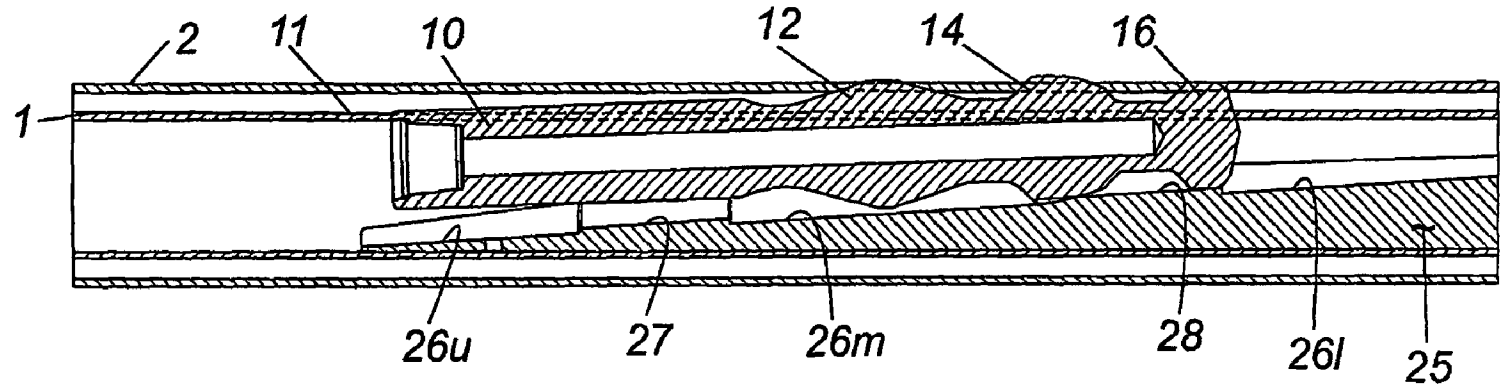

The lower milling head 16 breaks through the outer surface of the casing 2 just before it reaches the end of the second plateau portion 28, as shown in FIG. 22, so that it is supported by the second plateau portion 28 during the whole of its radial cutting procedure. As the lower milling head 16 moves off the lower end of the second plateau portion 28, the middle milling head 14 is moving onto the second plateau portion 28, which is typically being consumed at its upper end by the middle milling portion 14.

Once the lower milling head 16 has cut radially through the outer string of the casing 2, there is usually less resistance applied to it by the relatively softer formation, and it does not usually need to be supported by the whipstock 25 to the same extent as when cutting through casing 2. Thus, after the lower milling head 16 moves off the lower end of the second plateau portion 28, it is held clear of the deflection face 26 while it is cutting, which reduces the extent to which the deflection face 26*u* is consumed by the milling process at that point. Also, the milling device 10 can be supported by the upper and middle milling heads 12, 14 both of which can bear on the whipstock 25 and support the lower milling head clear of the deflection face 6. At this point, the window in the outer string 2 is being lengthened primarily by the axial cutting action of the forward facing blades on the conical leading face 16*c* of the lower milling head 16, while it is being widened circumferentially by the action of the middle and lower milling heads 14, 12, and the radial forces acting on the lower milling head are not as great as when it is cutting through the casing 1. Milling continues with the mill 10 proceeding along the track guided by the whipstock until the window is complete and the milling device 10 is fully in the lateral bore newly drilled in the formation.

In certain circumstances, the formation can be harder than the casing (e.g. in limestone, dolomite, or granite etc). This can tend to force the exiting mill back towards the axis of the casing, and affect adversely the intended angle of deviation of the lateral borehole. In such cases, the second plateau portion 28 can also assist in supporting and stabilizing the mill over the lower end of the whipstock to correct any deviation from the desired track caused by unexpected formation resistance.

Modifications and improvements can be incorporated without departing from the scope of the invention. It will be appreciated by those skilled in the art that the terms 'up' and 'down' relate to the well, and while used to identify relative movements in the drawings appended hereto, the actual direction of movement within the well might be different, particularly in the case of deviated or lateral bores, and limitations on the scope of embodiments of the invention should not be inferred by these and similar terms.

The invention claimed is:

1. A whipstock assembly for milling an aperture in a casing, the whipstock assembly comprising a milling device and a whipstock, wherein:

the whipstock has a longitudinal axis, and a deflection face having a surface which is angled with respect to the longitudinal axis to guide the milling device through the casing; and the milling device is adapted to be connected to the whipstock, the milling device having upper and lower milling heads arranged sequentially on the milling device;

wherein the whipstock has a plateau portion raised above the surface of the deflection face to support the lower milling head as the lower milling head engages the casing, wherein the interaction of the lower milling head with the plateau portion causes the milling device to pivot around one of the milling heads, changing an angle of the milling device with respect to the casing.

2. A whipstock assembly as claimed in claim 1, wherein the milling device has upper, lower and middle milling heads.

3. A whipstock assembly as claimed in claim 1, wherein the plateau portion is arranged to support the lower milling head during the cutting operation of the lower mill head through the casing.

4. A whipstock assembly as claimed in claim 1, wherein the plateau portion has an angled guide face to guide the path of the lower milling head through the casing, and wherein the angled guide face of the plateau portion is parallel to the angled face of the deflection surface of the whipstock.

5. A whipstock assembly as claimed in claim 1, wherein the milling device has upper, lower and middle milling heads, and is adapted to pivot around the middle milling head.

6. A whipstock assembly as claimed in claim 1, wherein the milling device has upper, lower and middle milling heads, and wherein the upper and middle milling heads are simultaneously deflected through the casing.

7. A whipstock assembly as claimed in claim 1, wherein at least one of the deflection face and the plateau portion can be provided with a hard material adapted to withstand milling to a greater extent than the casing.

8. A whipstock assembly as claimed in claim 1, wherein the plateau portion is adapted to withstand milling by the lower milling head and to support it during the cutting operation of the lower milling head though the casing, and is adapted to be consumed by the upper milling head.

9. A whipstock assembly as claimed in claim 1, wherein the interaction between the lower milling head and the whipstock lifts the milling head immediately above the lower milling head onto the deflection surface.

10. A whipstock assembly as claimed in claim 9, wherein the interaction between the milling head immediately above the lower milling head and the whipstock lifts the lower milling head onto the plateau portion.

11. A whipstock assembly as claimed in claim 1, wherein the axial length of the plateau portion with respect to the longitudinal axis of the whipstock is selected in accordance with the dimensions of the casing, milling device, and the whipstock in order to support the lower milling head during the full extent of the cutting operation through the casing.

12. A whipstock assembly as claimed in claim 1, wherein the plateau portion has a radial dimension, and wherein the radial dimension of the plateau portion is sufficient to divert the lower milling head towards the inner surface of the casing, so that the plateau portion supports the lower milling head closer to the inner surface of the casing than the deflection face.

13. A whipstock assembly as claimed in claim 1, wherein the lower milling head has a narrower diameter than the upper milling head.

14. A whipstock assembly as claimed in claim 1, having upper, lower and middle milling heads, the upper and middle milling heads having a similar apical diameter, which is larger than the apical diameter of the lower milling head.

15. A whipstock assembly as claimed in claim 1, wherein the milling device has upper, lower and middle milling heads, each of the milling heads having an apex, and wherein the plateau portion of the whipstock extends radially to an extent that in use pivots the milling device around the middle milling head, and pushes the apex of the lower milling head radially outwards to engage an inner surface of the casing at substantially the same time as the apex of the middle milling head.

16. A whipstock assembly as claimed in claim 1, wherein the milling heads have blades to cut through the casing, and the blades are helically offset in relation to one another.

17. A whipstock assembly as claimed in claim 16, each of the blades having leading and trailing ends, and wherein the trailing end of one blade on one milling head is circumferentially aligned with the leading end of another blade on an adjacent milling head.

18. A whipstock assembly as claimed in claim 1, wherein the whipstock has second or further plateau portions, for supporting the lower milling head during cutting operations through subsequent layers of casing.

19. A whipstock assembly for milling an aperture in a casing, the whipstock assembly having a milling device and a whipstock, wherein:

the whipstock has a longitudinal axis, and a deflection face having a surface which is angled with respect to the longitudinal axis to guide the milling device through the casing; and the milling device is adapted to be connected to the whipstock, the milling device having upper, middle and lower milling heads arranged sequentially on the milling device;

wherein the whipstock has a plateau portion raised above the surface of the deflection face to support the lower milling head as the lower milling head engages the casing, and wherein the milling device is adapted to pivot around the middle milling head.

20. A whipstock assembly for milling an aperture in a casing, the whipstock assembly having a milling device and a whipstock, wherein:

the whipstock has a longitudinal axis, and a deflection face having a surface which is angled with respect to the longitudinal axis to guide the milling device through the casing; and the milling device is adapted to be connected to the whipstock, the milling device having upper and lower milling heads arranged sequentially on the milling device;

wherein the whipstock has a plateau portion raised above the surface of the deflection face to support the lower milling head as the lower milling head engages the casing, and wherein the whipstock has second or further plateau portions, for supporting the lower milling head during cutting operations through subsequent layers of casing.

* * * * *